US007730876B2

(12) United States Patent
Yudanov

(10) Patent No.: US 7,730,876 B2
(45) Date of Patent: Jun. 8, 2010

(54) FUEL INJECTION SYSTEM

(75) Inventor: Sergi Yudanov, V. Frölunda (SE)

(73) Assignee: Volvo Lastvagnar AB, Göteborg (SE)

( * ) Notice: Subject to any disclaimer, the term of this patent is extended or adjusted under 35 U.S.C. 154(b) by 86 days.

(21) Appl. No.: 12/280,802

(22) PCT Filed: Feb. 23, 2007

(86) PCT No.: PCT/SE2007/000163

§ 371 (c)(1),
(2), (4) Date: Aug. 27, 2008

(87) PCT Pub. No.: WO2007/114750

PCT Pub. Date: Oct. 11, 2007

(65) Prior Publication Data

US 2009/0095258 A1 Apr. 16, 2009

(51) Int. Cl.
*F02M 69/54* (2006.01)
*F02M 69/46* (2006.01)

(52) U.S. Cl. ..... 123/456

(58) Field of Classification Search ..... 123/456, 123/447, 468, 469, 457, 459, 463; 138/26, 138/30

See application file for complete search history.

(56) References Cited

U.S. PATENT DOCUMENTS 4,462,368 A * 7/1984 Funada ..... 123/446
6,718,947 B1 4/2004 Mahr et al.
2004/0050367 A1 3/2004 Kurrle et al.
2004/0069276 A1 4/2004 Parche

FOREIGN PATENT DOCUMENTS

EP 1273797 A2 1/2003

OTHER PUBLICATIONS

International Search Report for corresponding International Application PCT/SE2007/000163.

* cited by examiner

*Primary Examiner*—Mahmoud Gimie
(74) *Attorney, Agent, or Firm*—WRB-IP LLP

(57) ABSTRACT

A fuel injection system for an internal combustion engine includes an engine management system, a return conduit connected to a low-pressure fuel system, and a common rail for storing and supplying a relatively high-pressure fuel to injectors. Each injector has a nozzle for injecting fuel into the engine, a valve installed between the common rail and the nozzle, and a spill valve connected by its inlet to the outlet of the valve and by its outlet to the return conduit. A first automatic isolating valve is installed between the common rail and the injector and a second automatic isolating valve is installed between the return conduit and the low-pressure fuel system.

6 Claims, 7 Drawing Sheets

FUEL INJECTION SYSTEM

BACKGROUND AND SUMMARY

The present invention relates to a fuel injection system for an internal combustion engine.

The present invention concerns fuel injection systems of internal combustion engines, in particular systems for injection of fuel directly into combustion cylinders of compression ignition engines. In particular, it concerns fuel injection systems featuring a control valve for pressure relief in the nozzle of the injector. Such solutions are typically applied in common rail injection systems for preventing a leakage of fuel through the closed nozzle, which is otherwise difficult to avoid when using low viscosity fuels such as DME.

An example of such a prior art system is shown in FIG. 1. In that system, there are automatic isolating valves for preventing leakage of fuel through the closed nozzles from the fuel supply system to the engine combustion chambers during system standby on a non-operating engine. By joining the return lines of a set of the injectors into a common line and then connecting that common line to the isolating valve, the total number of the isolating valves is kept low. There is however a disadvantage in this design which is the relatively big number of hydraulic connection ports in the injector.

Another disadvantage is a relatively big dead volume of the isolating valve which is added to the high-pressure volume confined between the control valve 10 and the nozzle 11. The bigger that dead volume, the bigger is the control leakage and the worse controllability due to delays associated with building up and relieving pressure in that volume.

In another example of a prior art system shown in FIG. 2, the number of connection ports in the injector is reduced from three to two, but at the expense of the increased number of the automatic isolating valves, two per injector.

A bigger number of either the hydraulic connection ports and/or isolating valves deteriorates reliability of the system and increases its cost. The present invention is intended to improve reliability, reduce cost, improve controllability and reduce leakage of the prior art systems.

Another issue with the prior art systems is a relative difficulty in controlling the nozzle opening pressure (NOP). It can be controlled by means of a pressure regulator installed between the spring chambers of the set of injectors and the return conduit, as shown in FIG. 3, which again implies three connection ports per injector. By providing a relatively large volume of the nozzle spring chamber, it is in principle possible to eliminate the NOP control port and have a pressure regulator connected between the return line and the return conduit as shown in FIG. 4, but in that case the NOP control is complicated by differences in the leakages along the nozzle needle guides of different injector samples, the influence of the residual pressure on the nozzle closing pressure and leakage past the closed nozzle, and is besides relatively slow-acting. The present invention also offers means of improving the NOP control in such fuel injection systems.

It is desirable to provide a fuel injection system with reduced complexity, improved energy efficiency and better controllability of injection rate.

The fuel injection system according to an aspect of the present invention incorporates a fuel tank, a feed pump and associated components forming a low-pressure system, and a high-pressure pump delivering fuel under pressure into a common rail, which supplies pressurised fuel to all injectors of a multi-cylinder engine. A first automatic isolating valve is installed between the common rail and the injector, which incorporates a three-way electrically operated pilot valve that controls a hydraulically operated valve positioned between the common rail and a nozzle, and an electrically operated, two-way, normally open spill valve positioned between the outlet of the hydraulically operated valve and a return line.

The nozzle has a needle that is biased by a return spring towards closing the nozzle. The return spring is installed in a spring chamber which, if pressurised, can assist the spring in biasing the needle towards nozzle closing. The spring chamber, the outlet of the pilot valve and the outlet of the spill valve are connected to an injector return line.

The return lines of the injectors are joined together into a single return conduit, which is connected via a second automatic isolating valve to the low-pressure system. A restriction is placed between the return line of each injector and the return conduit.

Installing the first automatic isolating valve between the common rail and the injector instead of installing it between the outlet of the hydraulically operated valve and the nozzle, as in the prior art systems, allows to reduce the dead volume upstream of the nozzle, which is drained between the injections, and by this means improve controllability and increase hydraulic efficiency of the injection system. Another advantage of this is a simplified design, improved reliability and reduced cost of the fuel injection system, because the injector can have only two connection ports, high pressure and return, and at the same time the total number of automatic isolating valves can be kept to a minimum equal to the number of injectors plus one. In prior art systems, the total number of the automatic isolating valves should be double the number of injectors if the latter have two ports. Otherwise, if a common automatic isolating valve is used in the return conduit of a prior art system, the number of ports on the injector must be increased to three.

Placing a restriction between the return line and the return conduit makes the fuel injection system adapted for control of the nozzle opening pressure, which can also be exercised individually for each injector and injection cycle and does not require additional pressure regulator as in the prior art systems.

BRIEF DESCRIPTION OF THE DRAWINGS

The invention will be further described in the following, in a non-limiting way with reference to the accompanying drawings in which.

DETAILED DESCRIPTION

Figure 5:
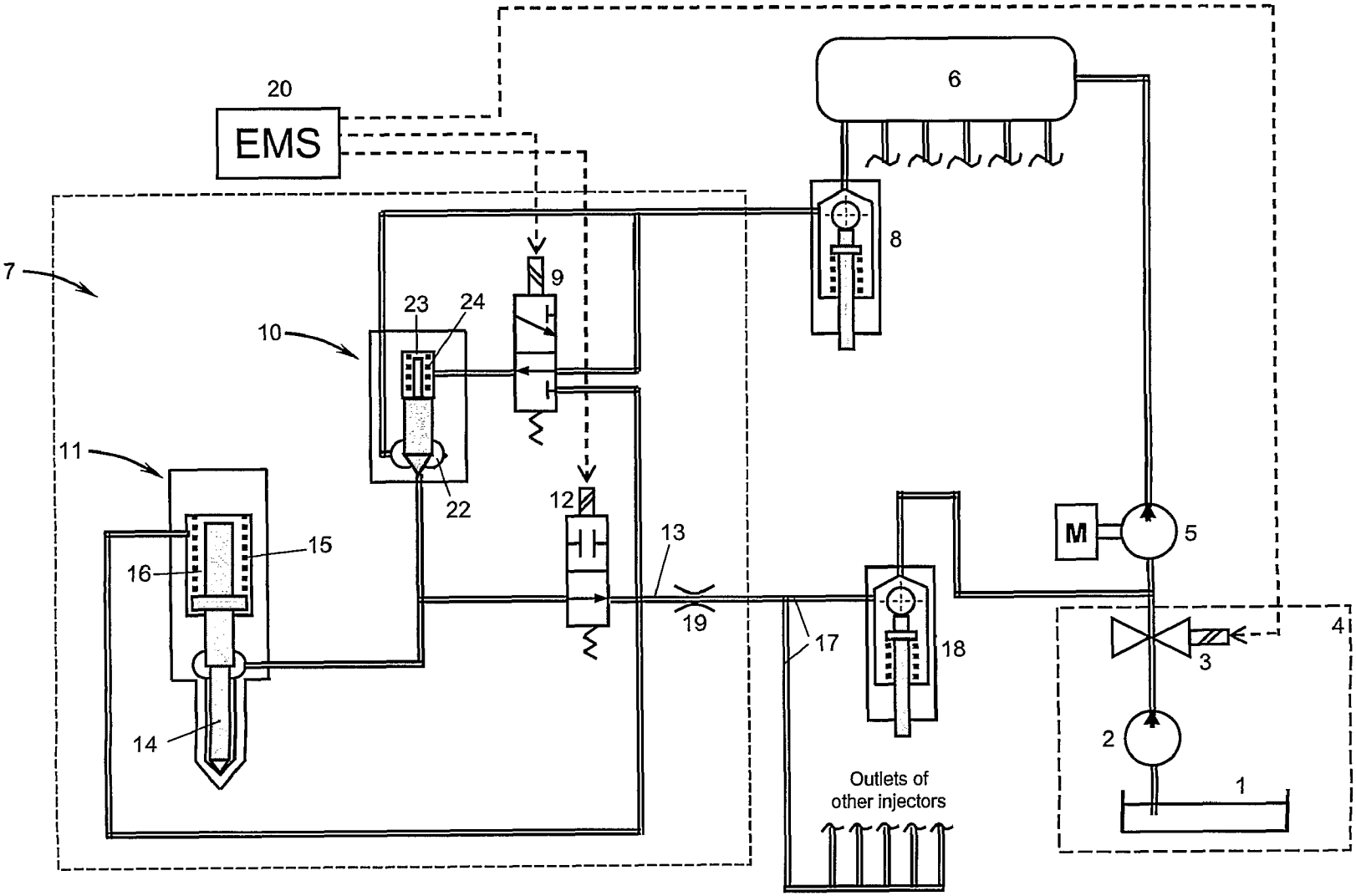
FIGS. 5, 6 and 7 are schematic representations of different embodiments of the invention.

In the preferred embodiment shown in FIG. 5, the fuel injection system according to present invention incorporates a fuel tank 1, a feed pump 2, an isolating valve 3 and other associated components (not shown) forming a low-pressure system 4, and a high-pressure pump 5 delivering fuel under pressure into a common rail 6, which supplies pressurised fuel to all injectors 7 of a multi-cylinder engine (not shown). A first automatic isolating valve 8 is installed between the common rail 6 and the injector 7, which latter one incorporates a three-way electrically operated pilot valve 9 that controls a hydraulically operated valve 10 positioned between the common rail and a nozzle 11, and an electrically operated, two-way, normally open spill valve 12 positioned between the outlet of the hydraulically operated valve 10 and a return line 13. The nozzle 11 has a needle 14 that is biased by a return spring 15 towards closing the nozzle. The return spring is installed in a spring chamber 16 which, if pressurised, can assist the spring 15 in biasing the needle 14 towards nozzle closing. The spring chamber 16, the outlet of the pilot valve 9 and the outlet of the spill valve 12 are connected to the return line 13.

The return lines 13 of the injectors are joined together into a common return conduit 17, which is connected via a second automatic isolating valve 18 to the low-pressure system 4. A restriction 19 is placed between the return line 13 of each injector and the return conduit 17. An engine management system (EMS) 20 controls the valves 9 and 12.

The hydraulically operated valve 10 preferably has a precision-matched stem and forms an outlet chamber 22 and a control chamber 23, and is preferably biased towards its closed position by a resilient means 24. The control chamber 23 of the valve 10 can be connected by the three-way pilot valve 9 to either the common rail 6 or the return line 13, depending on commands from the EMS 20.

The automatic isolating valves 8, 18 are designed such that, once the valve is open, the area of the valve that is exposed to the pressure of the fuel is sufficiently big to hold the valve open against the force of the valve's return spring when the pressure in the valve is anywhere from slightly below the feed pressure in the system or above that level. In case of engine being stopped and the feed pressure falling below a predetermined level, the automatic isolating valve closes and the area of the valve exposed to the pressure upstream of the valve becomes relatively small, such that a pressure above the feed pressure level is required to re-open the automatic isolating valve. The design of such a valve is known in the art and is disclosed, for example, in the U.S. Pat. No. 6,189,517 B1.

Referring to FIG. 5, the fuel injection system according to the present invention works as follows: In a no-injection state but with the engine running, there is feed pressure downstream of the low-pressure system 4 and in the return conduit 17; the high-pressure pump pressurizes the fuel to a certain level and maintains that level in the common rail 6. The valves 9 and 12 are not activated by the EMS 20. The three-way pilot valve 9, in its de-activated position, connects the common rail 6 to the control chamber 23 of the hydraulically operated valve 10. The pressure from the common rail, combined with the force of the resilient means 24, holds the valve 10 in its closed position. The spill valve 12 is open, connecting the outlet of the hydraulically operated valve 10 to the return line 13 and the return conduit 17 via the restriction 19. The automatic isolating valves 8, 18 are open, and pressure in the nozzle 11 equals pressure in the return conduit 17. The nozzle is closed by the needle return spring 15 and the force of the pressure in the spring chamber 16 acting on the needle 14.

To begin an injection, the EMS applies a control current to the pilot valve 9, which disconnects the control chamber 23 of the hydraulically operated valve 10 from the common rail 6 and connects it to the outlet of spill valve 12 and the inlet of the restriction 19. The pressure in the control chamber 23 falls and allows the common rail pressure acting on the valve from the outlet chamber 22 to open the valve 10 against the force of the resilient means 24. If a low-nozzle opening pressure is required, the EMS closes the spill valve 12 at about the same time, so that the fuel pressure at the inlet of the restriction 19, and therefore in the return line 13 and the spring chamber 16 of the nozzle 11, does not build up whilst it increases on the inlet side of the nozzle 11 and eventually opens the nozzle by lifting the needle 14 against the low pressure in the spring chamber 16 and the force of the return spring 15. If a higher nozzle opening pressure is required, the EMS applies control current to the spill valve 12 after a delay, allowing the fuel from the common rail to flow past the opening hydraulically operated valve 10 to build up pressure on both sides of the closed needle 14. When this pressure reaches a required level, the spill valve 12 gets closed by the EMS and the pressure on the back of the needle 14 is relieved to the return line 13, such that nozzle 11 opens and injection begins.

Figure 1:
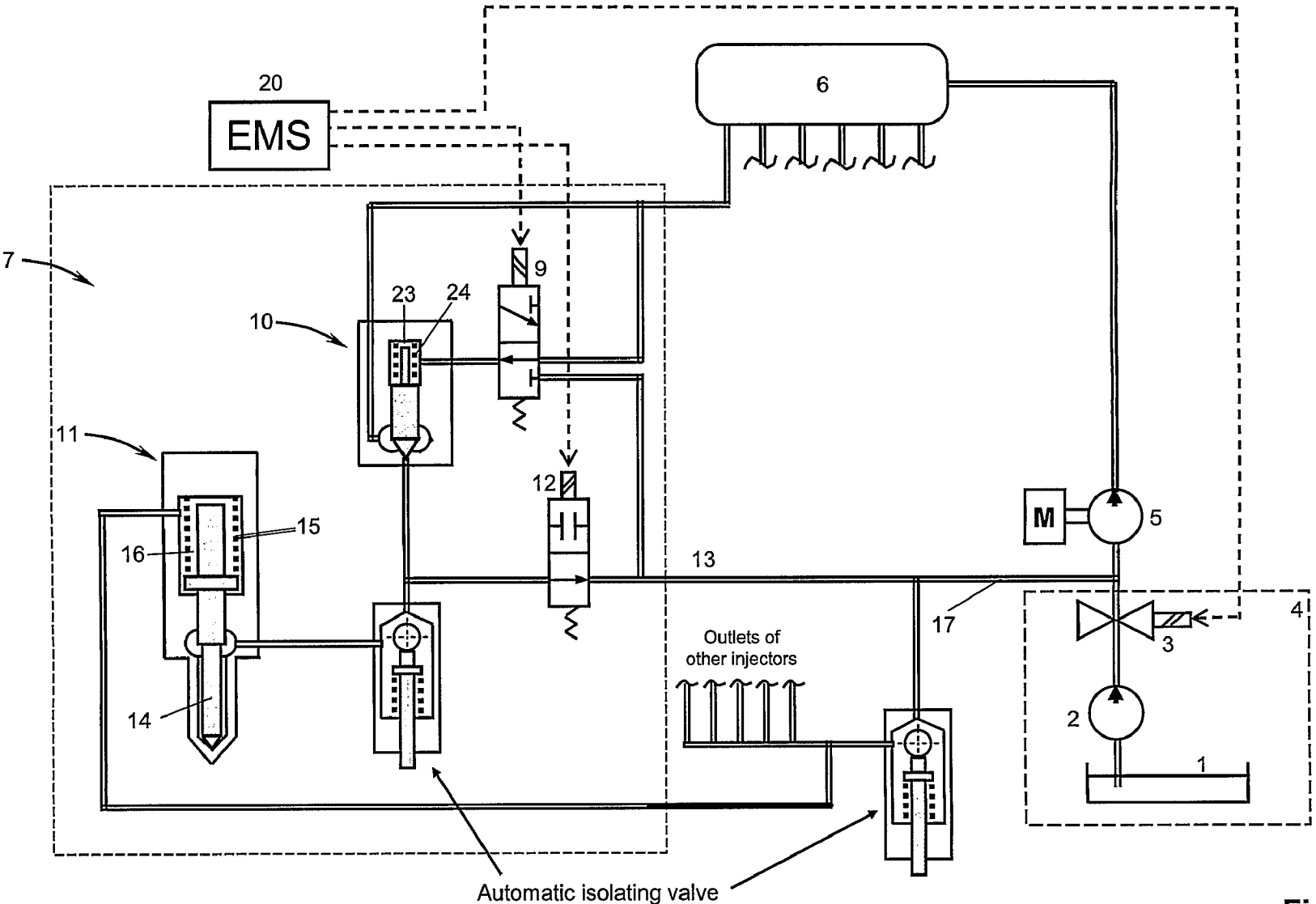
FIGS. 1-4 illustrate various designs of prior art systems.
Figure 2:
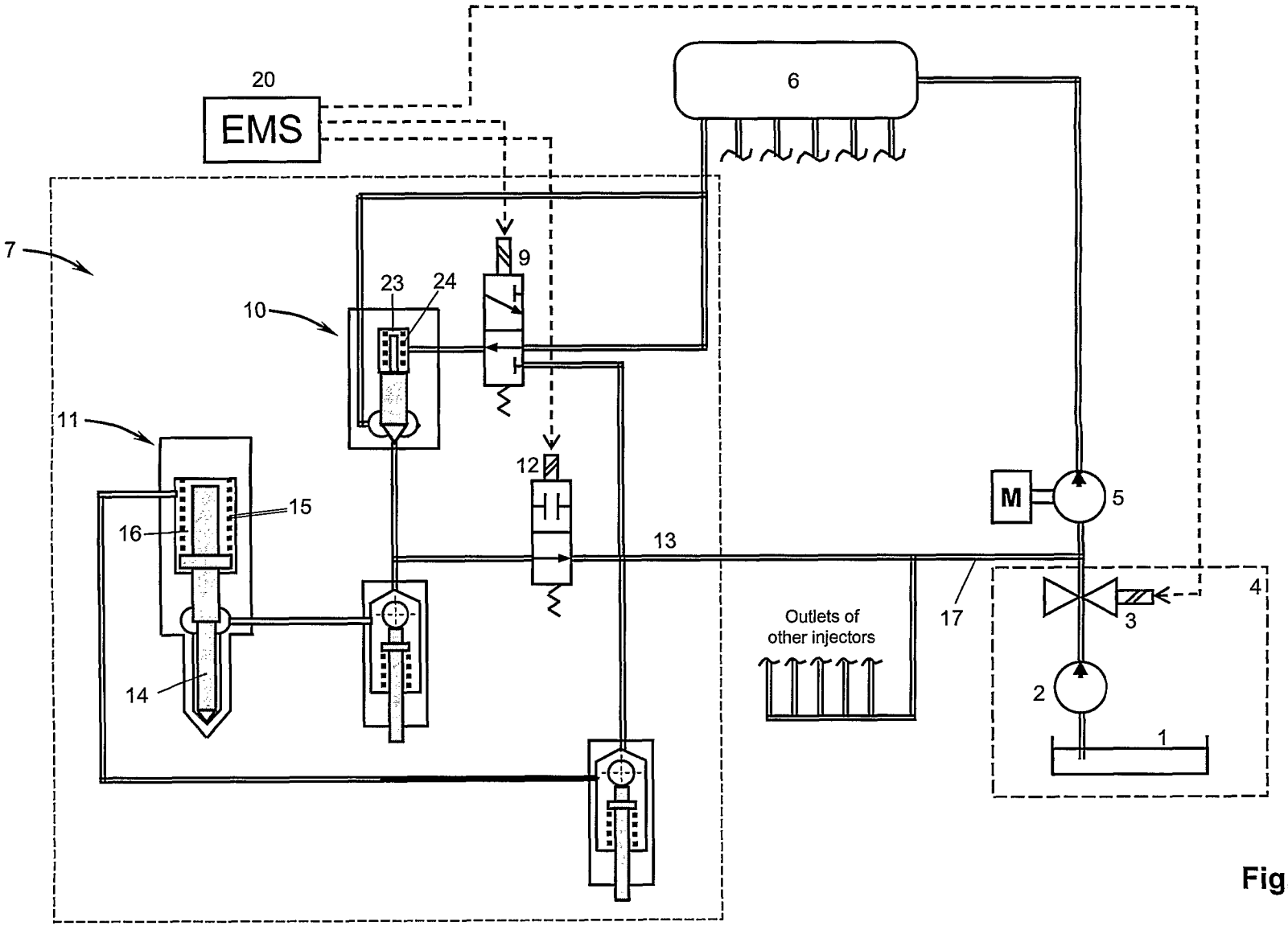
Figure 3:
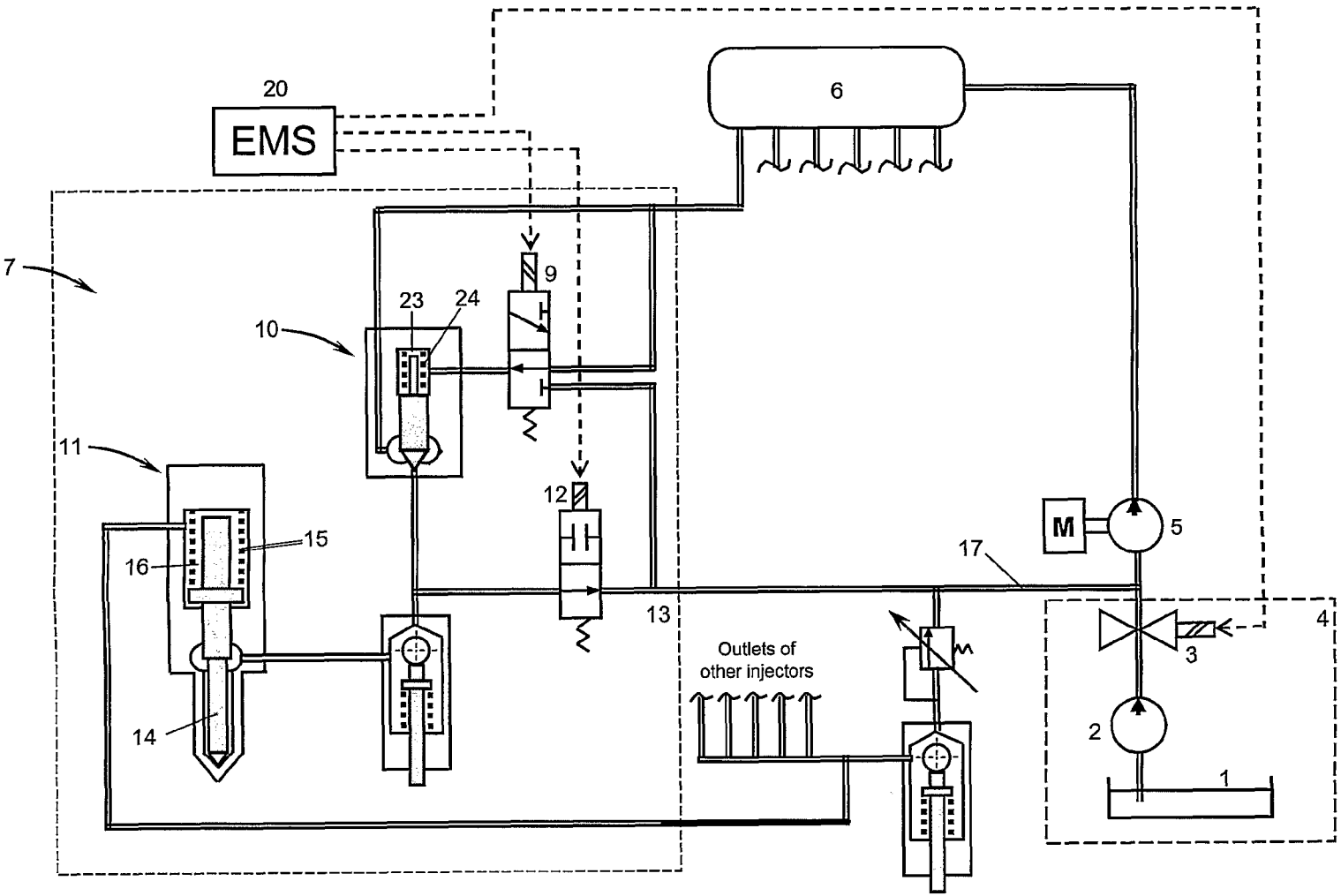
Figure 4:
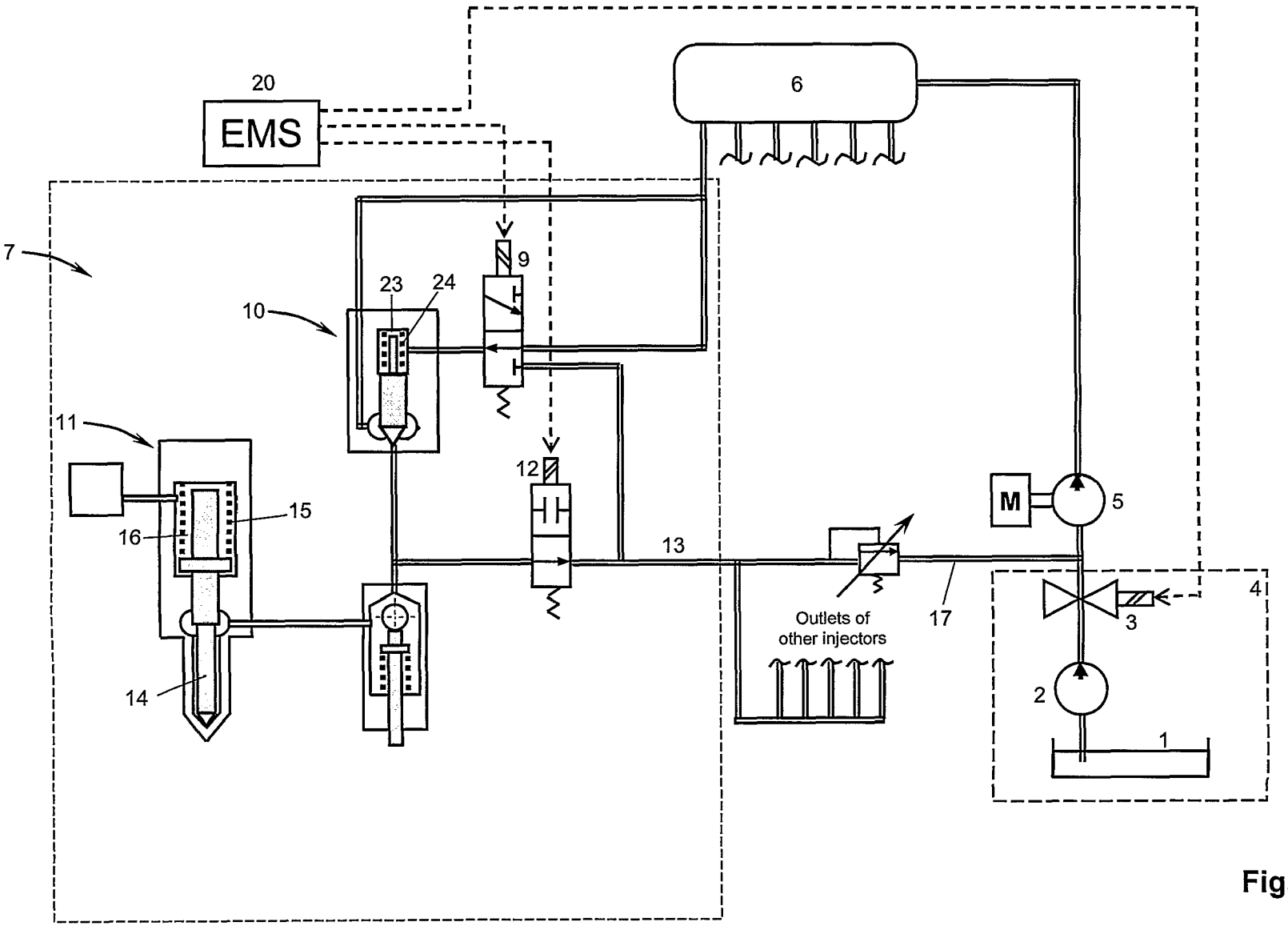

To terminate the injection, the EMS de-activates the pilot valve 9, which then disconnects the control chamber 23 from the return line 13 and connects it back to the common rail. The pressure in the control chamber 23 rises and, together with the resilient means 24, forces the valve 10 down towards the closed position. During the closing period of valve 10 and corresponding reduction of its flow area, the fuel continues to be injected from the open nozzle and the pressure in the nozzle falls until the return spring 15 moves the needle 14 down and closes the nozzle. Then the EMS de-activates and opens the spill valve 12 to relieve the nozzle of the residual pressure which can otherwise leak past the closed nozzle into the engine. Thus the system returns to its initial position as depicted by FIG. 1.

In case an injection with a quicker ending is required, the EMS opens the spill valve 12 before the nozzle 11 has been closed and while there is still a relatively high pressure upstream of the nozzle. This, because of the restriction 19, provides a surge of pressure in the return line 13 and in the spring chamber 16, which assists in closing the nozzle quicker.

When the engine is stopped, the pressure in the common rail can be reduced by, for example, activating the pilot valve 9 while keeping the spill valve 12 open, which essentially drains the fuel back to the low-pressure system. This leads to a reduction of pressure in the automatic isolating valves 8, 18 which then close and thereby prevent fuel from leaking through closed nozzles into the engine. This is because the valves 8, 18 in this case separate the relatively large volumes of common rail and associated components that may contain any residual pressure, from the nozzles.

Figure 6:
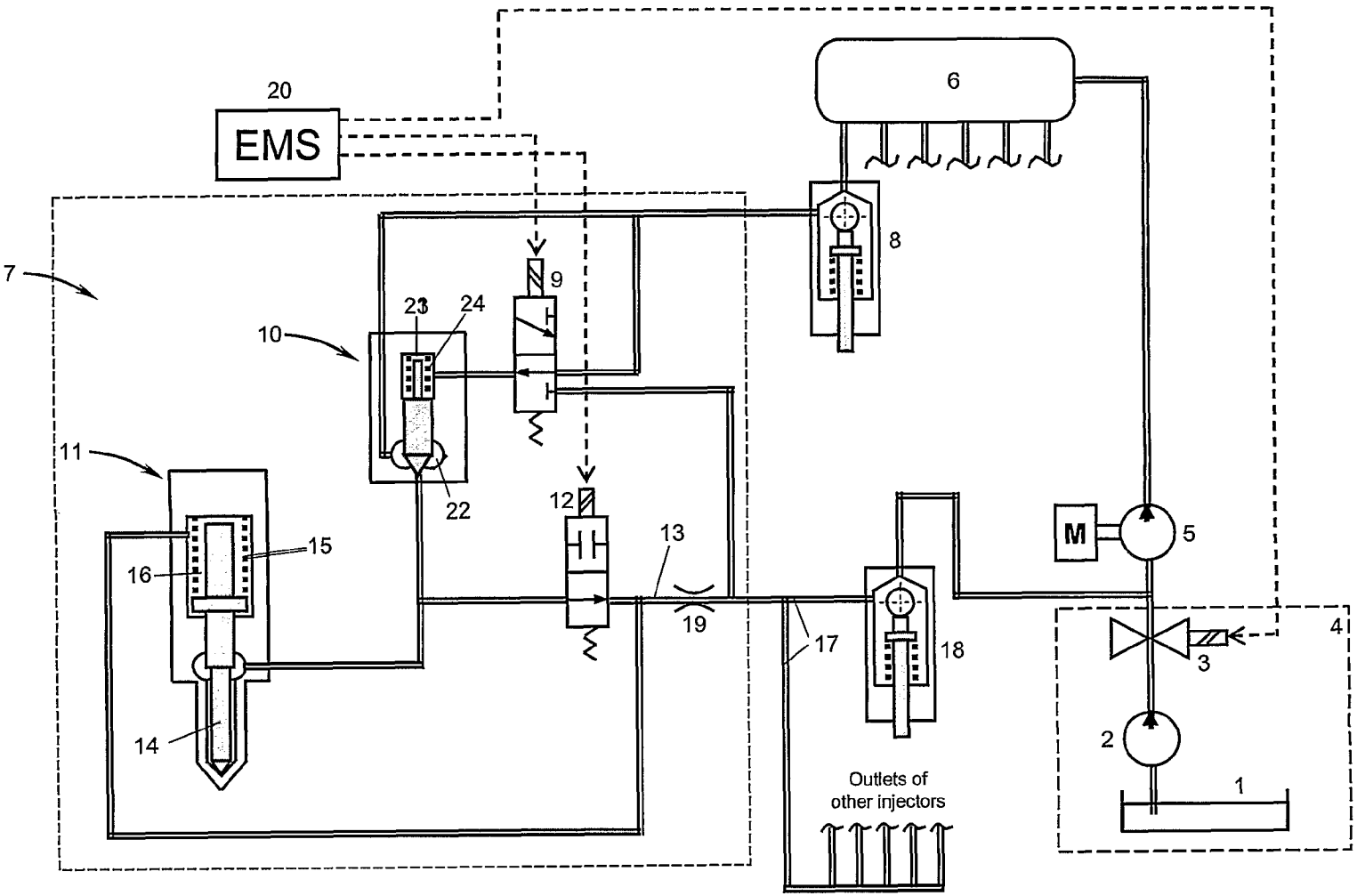

In FIG. 6, an alternative embodiment of the invention is shown, in which the outlet of the pilot valve 9 is connected to the return conduit 17, bypassing the restriction 19. This allows making the control of the hydraulically operated valve 10 less dependent of the NOP control.

Figure 7:
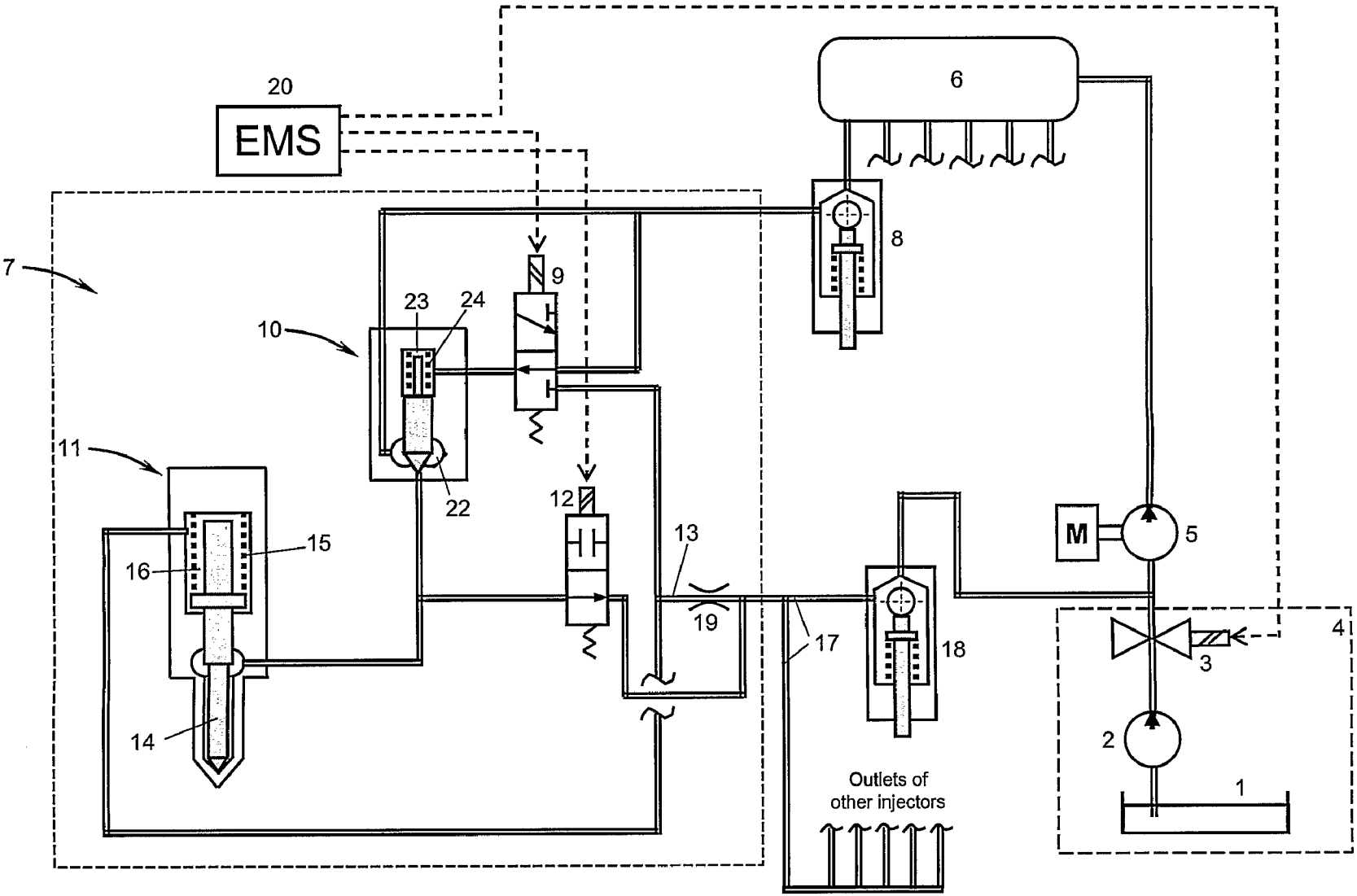

In FIG. 7, another alternative embodiment of the invention is shown, in which the outlet of the spill valve 12 is connected to the return conduit 17 and the outlet of the pilot valve 9 is connected to the return line 13. In such an embodiment, the NOP is directly influenced by the operation of the pilot valve only.

The invention is not limited to the above-described embodiments, but several modifications are possible within the scope of the following claims.

The invention claimed is:

1. A fuel injection system for an internal combustion engine, comprising an engine management system (20), a return conduit connected to a low-pressure fuel system, and a common rail for storing and supplying a relatively high-pressure fuel to injectors, each of the injectors having a nozzle for injecting fuel into the engine, a valve installed between the common rail and the nozzle, a spill valve connected by its inlet to the outlet of the valve and by its outlet to the return conduit, wherein a first automatic isolating valve is installed between the common rail and the injector and a second automatic isolating valve is installed between the return conduit and the low-pressure fuel system.

2. A fuel injection system according to claim 1, wherein the return conduit is common for the set of injectors of a multi-cylinder engine.

3. A fuel injection system according to claim 1, wherein the nozzle has a needle which is biased towards closing the nozzle by a force of pressure in a spring chamber, and that there is a return line connected to the outlet of the spill valve and to the inlet of a restriction, the outlet of the restriction being connected to the return conduit, wherein the spring chamber is connected to the return line.

4. A fuel injection system according to claim 3, wherein there is a pilot valve that is operable by the EMS to control the position of the valve, wherein the outlet of the pilot valve is connected to the return line.

5. A fuel injection system according to claim 4, wherein the outlet of the pilot valve is connected to the return conduit.

6. A fuel injection system according to claim 4, wherein the outlet of the spill valve is connected to the return conduit.

* * * * *